US005619865A

United States Patent [19]

Maxwell

[11] Patent Number: 5,619,865

[45] Date of Patent: Apr. 15, 1997

[54] REFRIGERATION SUBCOOLER

[76] Inventor: Ronal J. Maxwell, 15151 Berry Trail, No. 601, Dallas, Tex. 75248

[21] Appl. No.: 517,790

[22] Filed: Aug. 22, 1995

[51] Int. Cl.[6] ..... F25B 43/00

[52] U.S. Cl. ..... 62/474; 62/503; 62/509; 62/513

[58] Field of Search ..... 62/474, 503, 509, 62/513, 299, 298

[56] References Cited

U.S. PATENT DOCUMENTS

| | | | |
|---|---|---|---|
| 2,365,791 | 12/1944 | Wineman | 62/509 X |
| 2,518,299 | 8/1950 | Fernandez | 62/299 |
| 3,175,342 | 3/1965 | Balogh | 62/474 X |
| 4,180,988 | 1/1980 | Forte et al. | 62/474 |
| 4,236,381 | 12/1980 | Imral et al. | 62/503 X |
| 4,255,940 | 3/1981 | Grahl et al. | 62/474 X |
| 4,457,138 | 7/1984 | Bowman | 62/509 X |
| 4,488,413 | 12/1984 | Bottum | 62/503 |
| 5,222,378 | 6/1993 | Chuan | 62/474 |

*Primary Examiner*—Harry B. Tanner
*Attorney, Agent, or Firm*—Rosenblatt & Redano, P.C.

[57] ABSTRACT

The present invention relates to an improved refrigeration subcooler comprising an accumulator and receiver apparatus for use in a refrigeration unit or heat pump. Specifically, the present invention relates to a subcooler that requires less refrigerant and is operable at lower operating pressures than conventional subcoolers.

16 Claims, 4 Drawing Sheets

REFRIGERATION SUBCOOLER

BACKGROUND OF THE INVENTION

1. Field of the Invention

The present invention relates to an improved refrigeration subcooler comprising an accumulator and receiver apparatus for use in a refrigeration unit or heat pump. Specifically, the present invention relates to a subcooler that requires less refrigerant and is operable at lower operating pressures than conventional subcoolers.

2. Description of the Prior Art

The use of a heat exchanger comprising an outer housing that functions as an accumulator and an inner housing that functions as a receiver is well known in the refrigeration art. Such heat exchangers are known as "subcoolers." Such a subcooler is disclosed in U.S. Pat. No. 4,236,381 to Imral, et al. In prior art subcoolers, the accumulator is installed in the suction line of a compressor used in the refrigeration cycle for the purpose of preventing the introduction of liquid slugs or other impurities into the suction line of the compressor. The use of a filter medium, comprising desiccant, can be used in such receivers to facilitate the purification and/or drying of the refrigerant. The outer casing or accumulator stores liquid refrigerant.

Prior art refrigeration units commonly use refrigerants containing chlorofluorocarbons ("CFCs"). CFCs are known to have an adverse effect upon the environment. Accordingly, federal environmental regulations have been enacted which are aimed at reducing the release of CFCs into the environment.

After extended use, the filter and/or desiccant medium in a conventional receiver must be replaced. In the case where the refrigerant contains CFCs, the refrigerant must be evacuated from the system in many prior art accumulators/receivers before the filter and/or desiccant medium can be replaced. This evacuation process is costly and time consuming. One improvement of the present invention is the elimination of the need to evacuate system refrigerant prior to changing the filter medium in order to avoid the release of CFCs into the environment.

The accumulator/receiver of the present invention is also designed to operate with less refrigerant than prior art accumulators/receivers, thereby allowing greater energy conservation and lower operating pressures. Additionally, the accumulator/receiver of the present invention is designed to provide superior heat transfer and condensing capabilities over prior art accumulators/receivers.

SUMMARY OF THE INVENTION

The present invention is directed to a subcooler for use in a refrigeration unit or heat pump. The present invention comprises an internal chamber or receiver comprising an upper volumetric region and a lower volumetric region, wherein the volume in the upper volumetric region is larger than the volume in the lower volumetric region. This internal chamber is referred to herein as a "receiver."

The invention further comprises a filter housing mounted in the upper volumetric region of the internal chamber such that the top of the filter housing is substantially flush with the top of the internal chamber.

The invention further comprises a filter medium comprising desiccant disposed within the filter housing, a filter access port mounted in the top of the filter housing, an internal chamber inlet line connected to the filter access port, and an internal chamber outlet line extending into the lower volumetric region. A check valve is mounted in the bottom of the filter housing in such a way that fluid cannot flow up from the upper volumetric region into the housing.

The invention further comprises an outer housing or accumulator surrounding the internal chamber to define an annular region around the internal chamber. The outer housing has a depth that is greater than the depth of the internal chamber. The invention further comprises an outer housing inlet and an outer housing outlet line, both of which are connected to the outer housing.

DESCRIPTION OF THE PREFERRED EMBODIMENTS

Figure 1A:
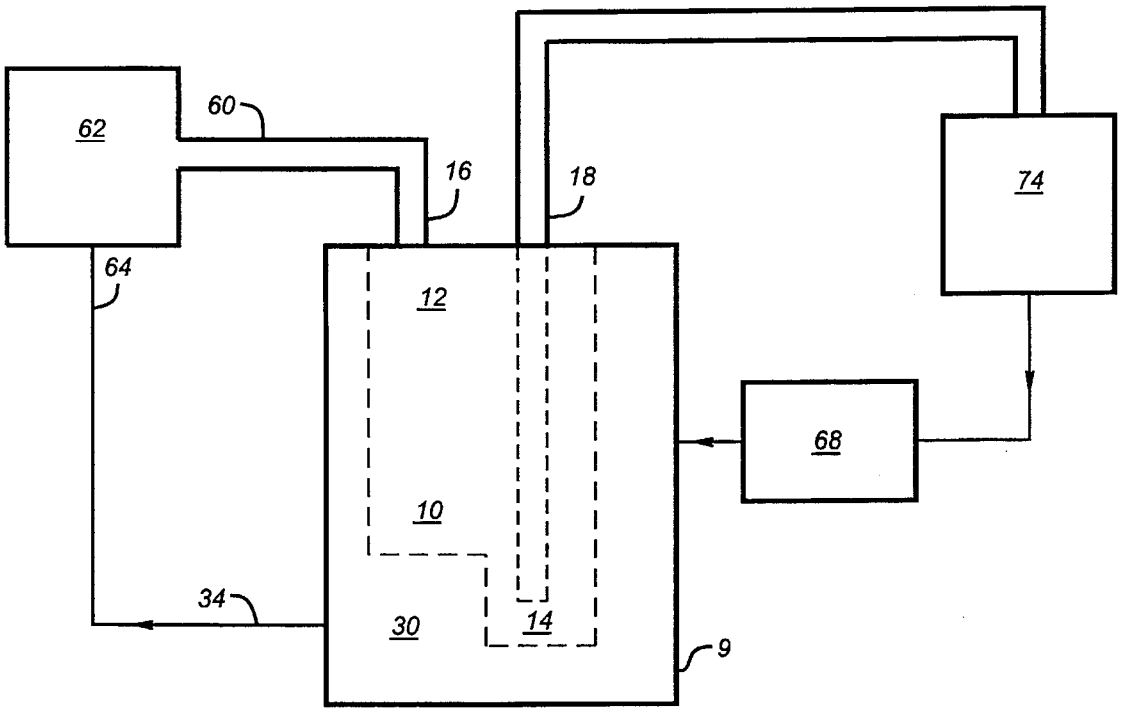
FIG. 1A is a block diagram of the present invention installed in a first refrigeration cycle.
Figure 1B:
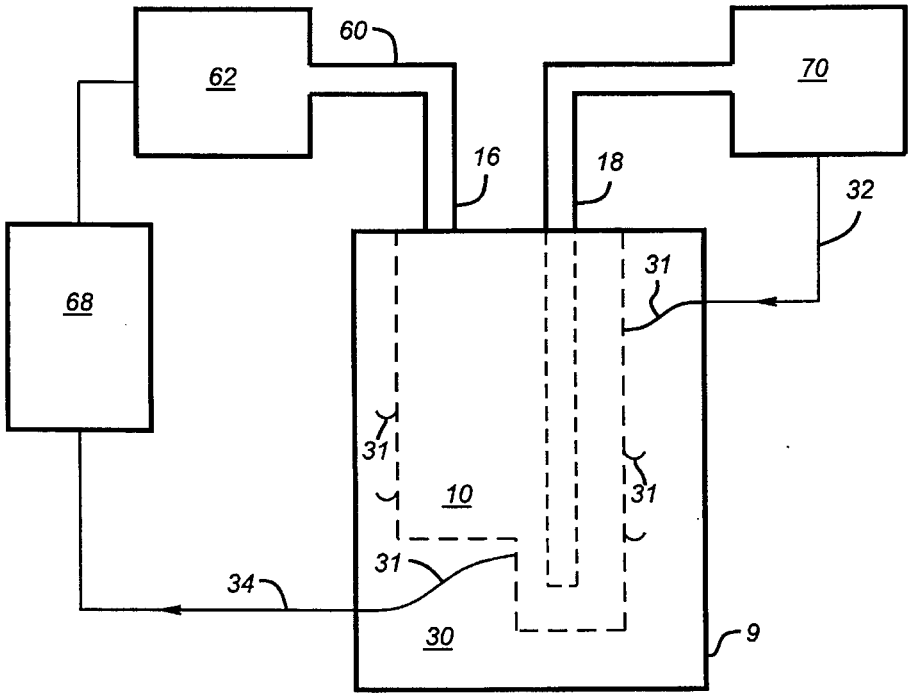
FIG. 1B is a block diagram of the present invention installed in a second refrigeration cycle.

FIGS. 1A and 1B are depictions of conventional refrigeration cycles, comprising the improved subcooler 9 of the present invention. As shown in FIG. 1A, the subcooler comprises an internal chamber or receiver 10 surrounded by an outer housing or accumulator 30. Internal chamber 10 has an inlet line 16 which may be connected in fluid communication with the discharge life 60 of a compressor 62 in a conventional refrigeration unit. Internal chamber 10 further has an outlet line 18 which may be coupled to either the inlet line 66, of a condenser 68, or an evaporator 70 of a conventional refrigeration unit, as shown in FIGS. 1A and 1B. Outer housing or accumulator 30 has an inlet line 32 which may be coupled to the evaporator 70 in a conventional refrigeration unit, as shown in FIG. 1B. Outer housing 30 further has an outlet line 34 which may be in fluid communication with the suction line 64 of a compressor 62 in a conventional refrigeration unit, as shown in FIGS. 1A and 1B.

In a preferred embodiment, outer housing 30 comprises a baffel 31 surrounding receiver 10 in a coiled configuration to improve refrigerant flow dispersion around receiver 10, thereby improving heat transfer between the receiver and the outer housing. In another preferred embodiment, the baffel may be made from a material having a high thermal conductivity, such as a metal, thereby increasing conductive heat transfer to the baffel.

Figure 2:
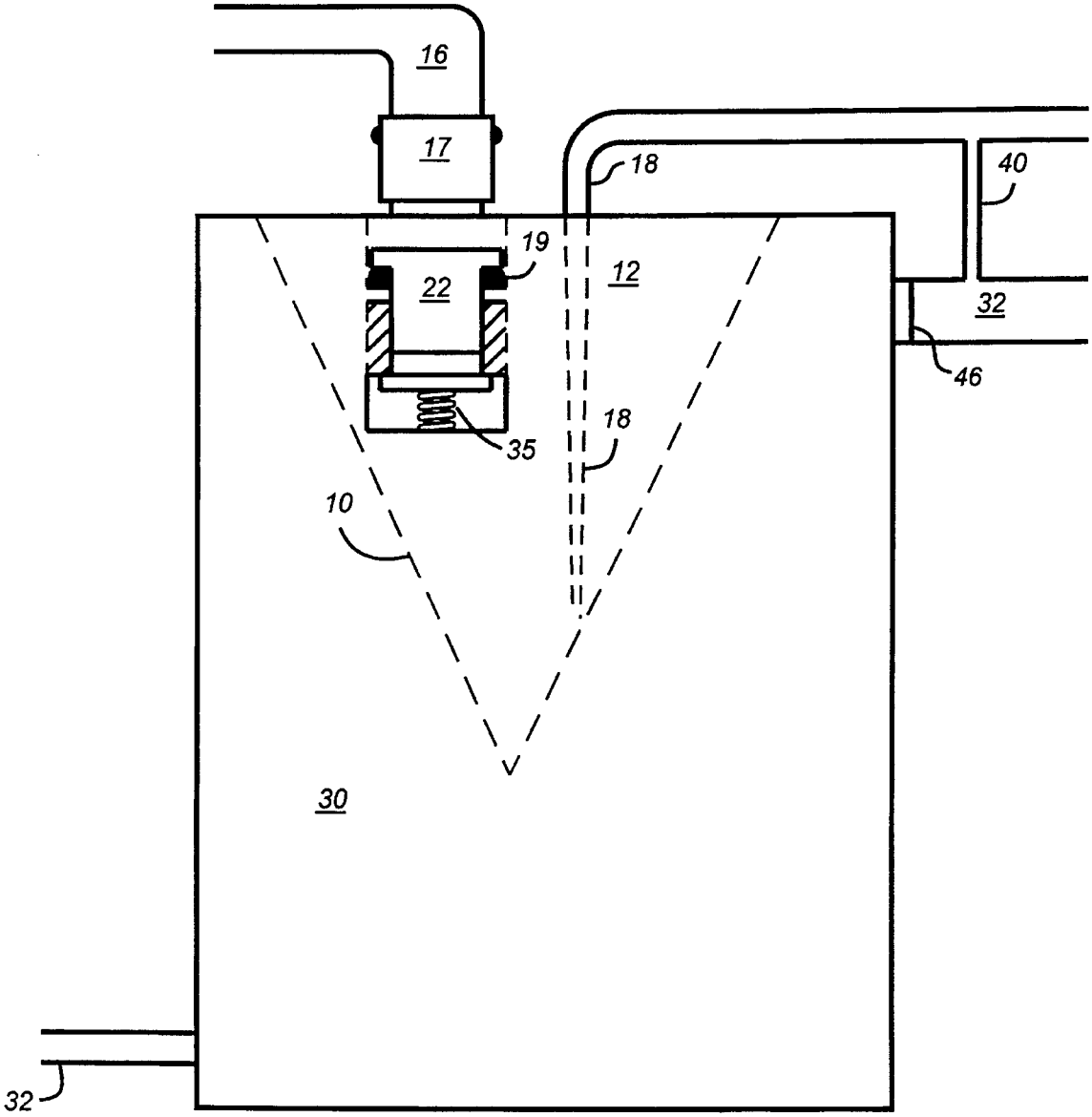
FIG. 2 is a side cutaway view of a first embodiment of the present invention.

Applicant's invention is particularly directed to the configuration of the improved subcooler. One preferred embodiment of Applicant's invention is shown in FIG. 2. As shown in FIG. 2, internal chamber 10 comprises an upper volumetric region 12 and a lower volumetric region 14 wherein the volume in the upper volumetric region is larger than the volume in the lower volumetric region. In the embodiment of the present invention depicted in FIG. 2, internal chamber 10 is conical.

Figure 3:
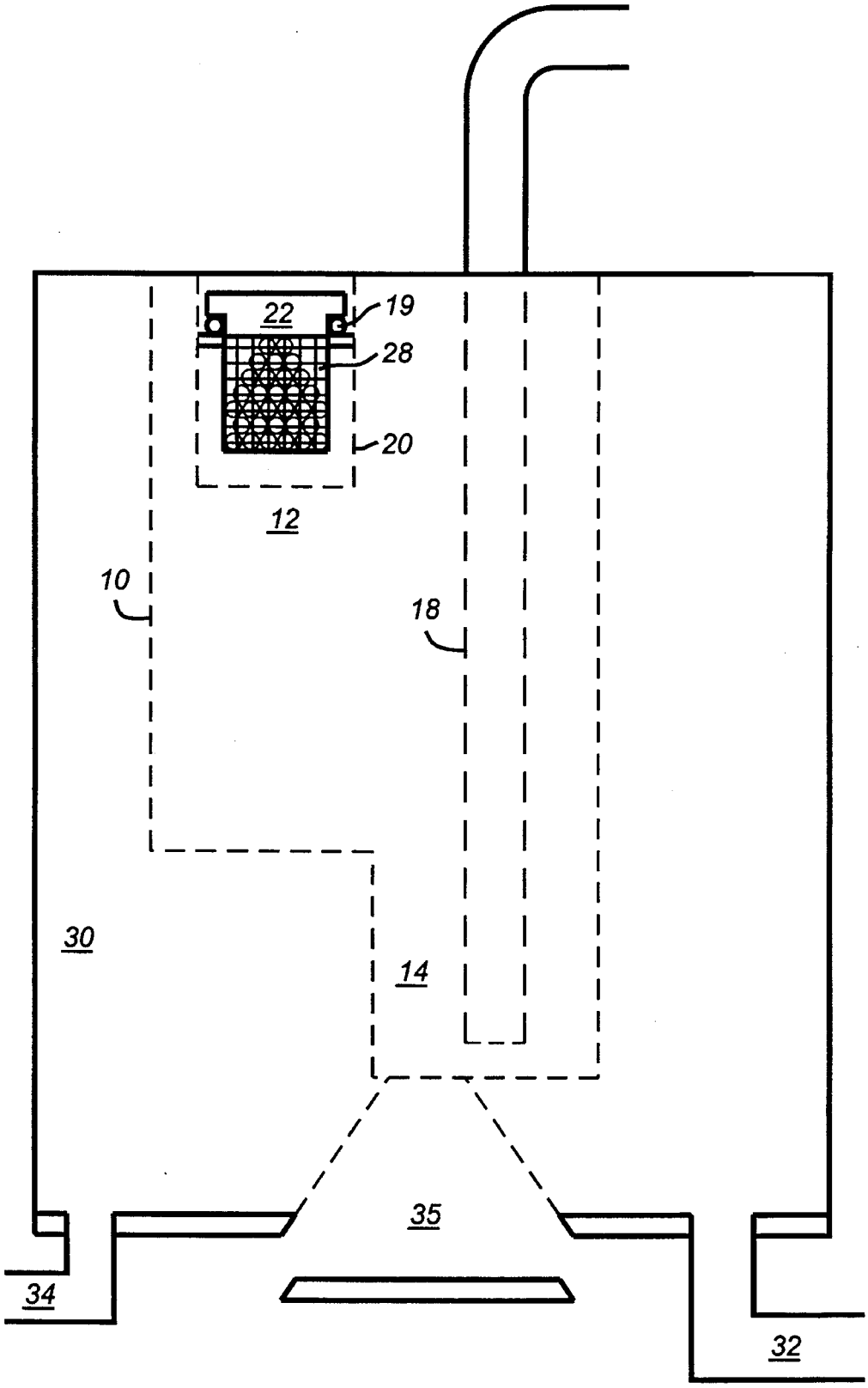
FIG. 3 is a side cutaway view of a second embodiment of the present invention.

In another preferred embodiment of the present invention, as depicted in FIG. 3, the upper and lower volumetric regions of internal chamber 10 are cylindrical, with the diameter of the lower volumetric being less than the diameter of the upper volumetric region. In a preferred embodiment, baffles or fins are disposed in the internal chamber 10 to direct the flow of refrigerant toward the wall of the internal chamber, thereby increasing heat transfer.

The present invention further comprises a filter housing 20 mounted in the upper volumetric region of the internal chamber such that the top of the filter housing is substantially flush with the top of the internal chamber. A filter medium comprising desiccant 22 is disposed within said filter housing, as shown in FIGS. 2 and 3. In a preferred embodiment, the filter medium is a disposable filter cartridge containing desiccant, as shown in FIG. 2 and the desicant is a molecular sieve desicant such as that sold under the trade names "XH-7" or "XH-9" by UOP of Des Plaines, Ill. In another preferred embodiment, the filter medium comprises pellets of desiccant housed in a wire-mesh screen 28, as shown in FIG. 3.

Figure 4:
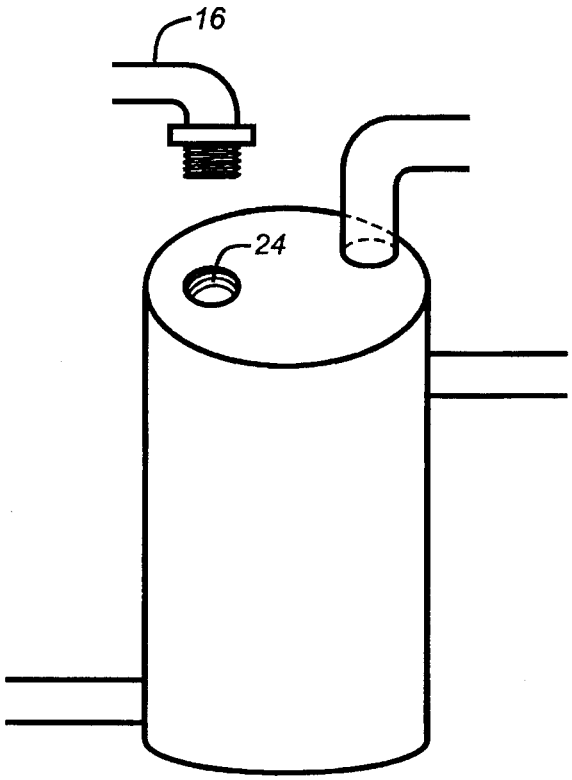
FIG. 4 is an isometric top view of the present invention.

The invention further comprises a filter access port 24 mounted in the top of said filter housing, as shown in FIG. 4. Internal chamber inlet line 16 is connected to said filter access port. In a preferred embodiment, as shown in FIG. 2, the invention further comprises an O-ring 19 installed at the junction of the internal chamber inlet line in the access port. The O-ring is capable of maintaining a fluid tight seal at this junction. In a preferred embodiment, the O-ring is made from hydrogenated nitrite butadiene rubber. In a preferred embodiment, the invention also comprises a quick release valve 17 connecting the access port to the internal chamber inlet line.

The invention further comprises an internal chamber outlet line 18 extending into the lower volumetric region. In a preferred embodiment, the internal chamber outlet line extends substantially to the bottom of the lower volumetric region, as shown in FIG. 3.

Figure 5:
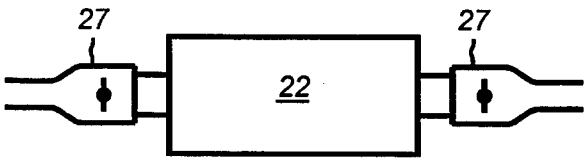
FIG. 5 is a side view of a preferred embodiment of a filter housing of the present invention.

In a preferred embodiment, as shown in FIG. 5, the present invention further comprises quick disconnect valves 27 with positive shutoff capabilities installed on the inlet and outlet sides of the filter housing, connecting the filter housing to the internal chamber inlet line and further capable of isolating fluid flow between the filter housing and the internal chamber. This feature permits isolation and quick removal of the filter housing when it must be replaced. This capability significantly reduces the time and costs associated with filter replacement.

The present invention further comprises a check valve 35 mounted in the bottom of the filter housing in such a way that fluid cannot flow up from the upper volumetric region into the filter housing. In one preferred embodiment, as shown in FIG. 2, the check valve is spring loaded.

The present invention further comprises an outer housing or accumulator 30 surrounding the internal chamber and defining an annular region around the internal chamber. The outer housing has a depth that is greater than the depth of said internal chamber, as shown in FIGS. 2 and 3. An outer housing inlet line 32 is connected to the outer housing. In a preferred embodiment, the outer housing inlet line is connected to the bottom of the outer housing. An outer housing outlet line 34 is also connected to the bottom of the outer housing. In another preferred embodiment, as shown in FIG. 3, the outer housing outlet line is connected to the bottom of the outer housing. In another preferred embodiment, the outer housing comprises a removable access port 35 installed in the base of said outer housing, as shown in FIG. 3. Access port 35 may extend into said internal chamber 10.

In the embodiment of the present invention shown in FIG. 2, a bypass line 40 connects the internal chamber outlet line with the outer housing inlet line. This bypass line permits the injection of liquid refrigerant into the outer housing inlet line, thereby facilitating the cooling process. In another preferred embodiment, as shown in FIG. 2, the invention further comprises a check valve 46 installed in the outer housing inlet line, configured to permit fluid flow into the outer housing and to prevent fluid flow out of the outer housing through the outer housing inlet line.

Many modifications and variations may be made in the embodiments described herein and depicted in the accompanying drawings without departing from the concept of the present invention. Accordingly, it is clearly understood that the embodiments described and illustrated herein are illustrative only and are not intended as a limitation upon the scope of the present invention.

What is claimed is:

1. An accumulator and receiver apparatus for use in a refrigeration unit or heat pump, comprising:

a. an internal chamber comprising an upper volumetric region and a lower volumetric region, wherein the volume in the upper volumetric region is larger than the volume in the lower volumetric region;

b. a filter housing mounted in the upper volumetric region of said internal chamber, such that the top of the filter housing is substantially flush with the top of said internal chamber;

c. a filter medium comprising desiccant disposed within said filter housing;

d. a filter access port mounted in the top of said filter housing;

e. an internal chamber inlet line connected to said filter access port;

f. an internal chamber outlet line extending into said lower volumetric region;

g. a check valve mounted in the bottom of said filter housing in such a way that fluid cannot flow up from said upper volumetric region into said filter housing;

h. an outer housing surrounding said internal chamber to define an annular region around said internal chamber, said outer housing having a depth that is greater than the depth of said internal chamber;

i. an outer housing inlet line connected to said outer housing; and j. an outer housing outlet line connected to said outer housing.

2. The apparatus of claim 1, wherein said check valve is spring loaded.

3. The apparatus of claim 1, wherein said filter medium comprises pellets of desiccant housed in a wire mesh screen.

4. The apparatus of claim 1, wherein said filter medium is a filter cartridge containing desiccant.

5. The apparatus of claim 1, further comprising an O-ring at the junction of said internal chamber inlet line and said access port, said O-ring capable of maintaining a fluid tight seal at said junction.

6. The apparatus of claim 1, further comprising a quick release valve connecting said access port to said internal chamber inlet line.

7. The apparatus of claim 1, wherein said internal chamber outlet line extends substantially to the bottom of said lower volumetric region.

8. The apparatus of claim 1, wherein said internal chamber is conical.

9. The apparatus of claim 1, wherein said upper and lower volumetric regions are cylindrical.

10. The apparatus of claim 1, wherein said outer housing inlet line is connected to the bottom of said outer housing.

11. The apparatus of claim 1, wherein said outer housing outlet line is connected to the bottom of said outer housing.

12. The apparatus of claim 1, further comprising a bypass line connecting said internal chamber outlet line with said outer housing inlet line.

13. The apparatus of claim 1, further comprising a check valve installed in said outer housing inlet line, configured to permit fluid flow into said outer housing and to prevent fluid flow out of said outer housing through said outer housing inlet line.

14. An accumulator and receiver apparatus for use in a refrigeration unit or heat pump, comprising:

a. an internal chamber comprising an upper volumetric region and a lower volumetric region, wherein the volume in the upper volumetric region is larger than the volume in the lower volumetric region;

b. an internal chamber inlet line extending into said upper volumetric region;

c. an internal chamber outlet line extending into said lower volumetric region;

d. a filter housing mounted inline in the portion of said internal chamber inlet line extending into said upper volumetric region;

e. a filter medium comprising desiccant disposed within said filter housing;

f. a check valve mounted in the bottom of said filter housing in such a way that fluid cannot flow up from said upper volumetric region into said filter housing;

g. an outer housing surrounding said internal chamber to define an annular region around said internal chamber, said outer housing having a depth that is greater than the depth of said internal chamber;

h. an outer housing inlet line connected to said outer housing; and i. an outer housing outlet line connected to the bottom of said outer housing.

15. The apparatus of claim 14, wherein said outer housing comprising a removable access port installed in the base of said outer housing.

16. The apparatus of claim 14, further comprising quick disconnect valves with positive shutoff capabilities installed on the inlet and outlet sides of said filter housing, connecting said filter housing to said internal chamber inlet line and further capable of isolating fluid flow between said filter housing and said internal chamber inlet line.

* * * * *